US005993239A

United States Patent [19]

Wright

[11] Patent Number: 5,993,239

[45] Date of Patent: Nov. 30, 1999

[54] POSITIVE LATCH CONNECTOR

[75] Inventor: John O. Wright, York, Pa.

[73] Assignee: Osram Sylvania Inc., Danvers, Mass.

[21] Appl. No.: 09/111,670

[22] Filed: Jul. 8, 1998

[51] Int. Cl.[6] ..... H01R 13/627

[52] U.S. Cl. ..... 439/357; 439/353

[58] Field of Search ..... 439/350, 351, 439/355, 357, 358, 345, 347, 353

[56] References Cited

U.S. PATENT DOCUMENTS

| | | | |
|---|---|---|---|
| 4,211,461 | 7/1980 | Wescott | 439/357 |
| 5,131,862 | 7/1992 | Gershfeld | 439/357 |
| 5,376,016 | 12/1994 | Inaba et al. | 439/357 |

*Primary Examiner*—Hien Vu
*Attorney, Agent, or Firm*—William H. McNeill

[57] ABSTRACT

A positive latch connector is provided which includes a first component which includes at least one resilient arm having a pin extending therefrom at a distal end thereof. A mating second component is provided which includes inclined first and second ramps, and an oppositely inclined third ramp. In use, the pin is moved along the first ramp against an elastic member until the pin snaps into a first latch groove to lock the first and second components in place. To release the components from each other, the pin is moved further against the elastic member along the second ramp to a second latch groove from which the pin is urged by the elastic member in an opposite direction along the third ramp, thereby allowing the components to be separated.

20 Claims, 3 Drawing Sheets

POSITIVE LATCH CONNECTOR

TECHNICAL FIELD

The present invention relates to a positive latch connector. More particularly, the present invention relates to a positive latch connector for use with electrical connectors such as those used, for example, with an antenna connector.

BACKGROUND ART

Typical electrical connectors such as, for example those used with an antenna connector for an antenna cable such as that used in the automobile industry for radios, include a male connector body generally in the form of a plug and a female connector body generally in the form of a ferrule which forms a socket. In use, the male connector body is plugged into the female connector body to effect a mechanical and electrical connection between the two. Typically, an antenna cable in the form of a coaxial cable is electrically and mechanically attached to one of the connectors such as the male connector, and the other connector, such as the female connector, is electrically and mechanically attached to a circuit such as a circuit on a printed circuit board. In such electrical connectors there is a tendency for the male and female components to become unintentionally disconnected due to opposing axially directed forces which are sometimes inadvertently exerted upon the male connector relative to the female connector. In addition, the lack of satisfactory tactile feedback makes it difficult to know when a suitable connection has been made. One known positive latch connector which does prevent inadvertent disconnection and provides tactile feedback during assembly is described in U.S. Pat. No. 5,599,199 granted to the present inventor on Feb. 04, 1997. The present invention provides a positive latch connector having features in addition to those provided in U.S. Pat. No. 5,599,199. For example, the positive latch connector of U.S. Pat. No. 5,599,199 provides only one form of tactile feedback and does not provide means for facilitating the disconnection of the connector.

DISCLOSURE OF THE INVENTION

It is, therefore, an object of the invention to obviate the disadvantages of the prior art.

It is an object of the present invention to provide an improved positive latch connector.

It is a further object of the present invention to provide a positive latch connector which provides visual evidence of an incomplete connection.

It is yet another object of the present invention to provide a positive latch connector the use of which permits the user to rely upon more than one means of tactile feedback to determine whether a complete connection has been made.

It is another object of the present invention to provide a positive latch connector which facilitates disconnection thereof.

Yet another object of the present invention is to provide a positive latch connector which prevents inadvertent disconnection thereof.

A further object of the present invention is to provide an electrical connector which includes the positive latch connector of the present invention.

Another object of the present invention is to provide such an electrical connector for use as an antenna connector.

Yet another object of the invention is the enhancement of electrical connectors.

This invention achieves these and other results, in one aspect of the invention, by providing a positive latch connector which comprises a first connector body extending in the direction of a first axis and a second connector body extending in the direction of a second axis. The first connector body comprises at least one first connector which comprises a first and second latch groove, a first, second and third ramp and an elastic member. The first latch groove extends into an outer surface of the first connector body to a first base and is positioned between a first end and a second end of the first connector body. The second latch groove extends into such outer surface to a second base and is positioned between the first latch groove and the second end of the first connector body. The first ramp is inclined away from the first axis in a direction extending from the first end of the first connector body towards the first latch groove. The second ramp is inclined away from the first axis in a direction extending from the first latch groove towards the second latch groove. The elastic member extends between the first and second latch groove. The third ramp is adjacent to at least the first ramp and is inclined away from the first axis in a direction extending towards the first end of the first connector body. The second connector body comprises at least one second connector. Each second connector comprises a beam which comprises a pin which (a) engages the first ramp in a connecting mode, (b) compresses the elastic member and engages the first latch groove in a connected mode, and (c) further compresses the elastic member and sequentially engages the second ramp, the second latch groove and the third ramp in a disconnecting mode.

BRIEF DESCRIPTION OF THE DRAWINGS

This invention may be clearly understood by reference to the attached drawings in which.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
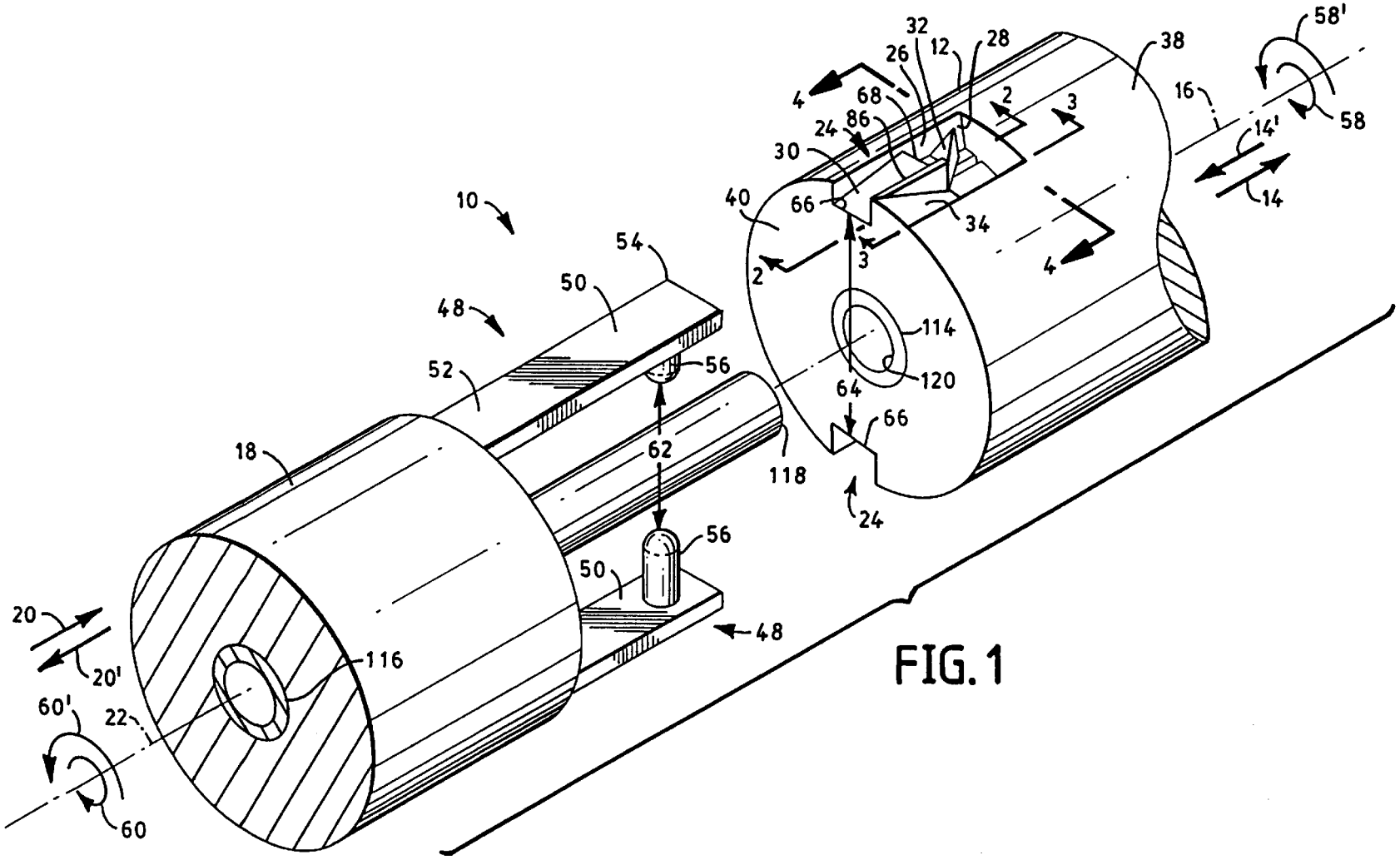
FIG. 1 is an exploded perspective view of one embodiment of the present invention with elastic member 36 removed for clarity.

Referring now to the drawings with greater particularity, FIG. 1 depicts a positive latch connector 10 which includes a first connector body 12 which extends in the direction 14, 14' of a longitudinal axis 16 of the first connector body, and a second connector body 18 which extends in the direction 20, 20' of a longitudinal axis 22 of the second connector body. When the first connector body 12 is connected to the second connector body 18, axes 16 and 22 will be coincident as depicted in FIG. 1. In the embodiment depicted in the drawings the first connector body 12 and the second connector body 18 are each cylindrical.

The first connector body comprises at least one connector. In the embodiment of FIG. 1 the first connector body 12 includes two connectors 24, although more or less connectors 24 may be provided. Each connector 24 includes a first latch groove 26, a second latch groove 28, a first ramp 30, a second ramp 32 and a third tramp 34. An elastic member 36 (not shown in FIG. 1) is also provided. The elastic member 36 is positioned between the latch groove 26 and the latch groove 28. In the embodiment illustrated in FIGS. 1 to 4, the elastic member 36 is fabricated from an elastomer, rubber or the like material, such as foam rubber.

Each latch groove 26 extends into an outer peripheral surface 38 of the first connector body 12 and is spaced from an end 40 of the first connector body in the direction 14 of axis 16. Latch groove 26 includes a base 42 which is disposed below outer peripheral surfaces 38. Latch groove 26 is positioned between the first end 40 of the first connector body 12 and a second end 44 thereof.

The second latch groove 28 extends into outer peripheral surface 38 to a second base 46 which is disposed below surface 38. The latch groove 28 is positioned between the latch groove 26 and the end 44 of the first connector body 12.

Figure 2:
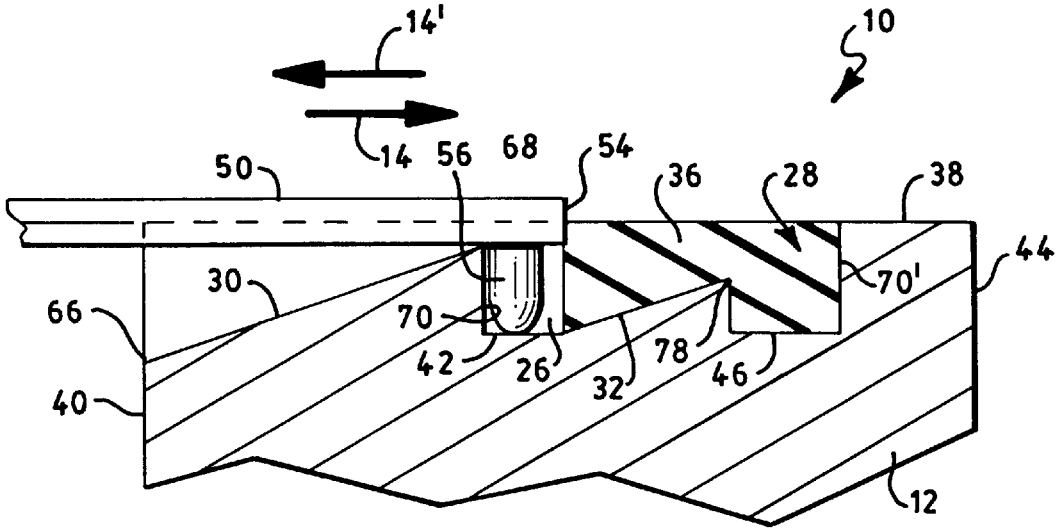
FIG. 2 is a cross-section of FIG. 1 along lines 2—2.
Figure 3:
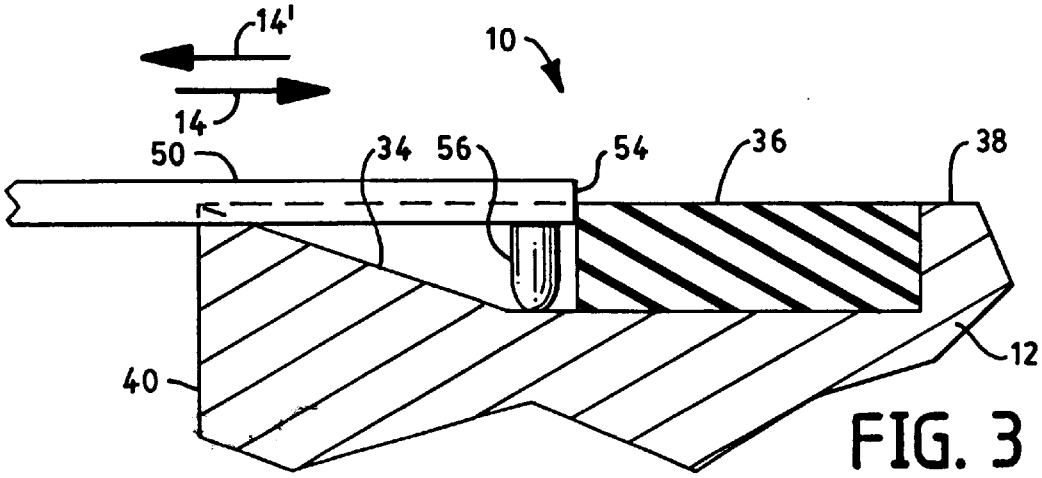
FIG. 3 is a cross-section of FIG. 1 along lines 3—3.
Figure 4:
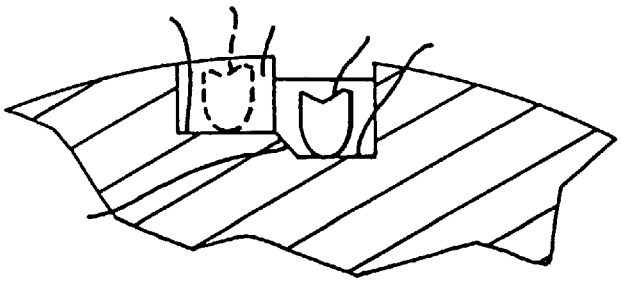
FIG. 4 is a cross-section of FIG. 1 along lines 4—4.

The first ramp 30 and the second ramp 32 are inclined upwards from end 40, and the third ramp 34 is inclined downwards from end 40 as depicted in FIGS. 2 and 3, respectively. In particular, ramp 30 is inclined away from axis 16 in a direction extending from end 40 towards the latch groove 26. Ramp 32 is inclined away from axis 16 in a direction extending from the latch groove 26 towards latch groove 28. Ramp 34 is inclined away from axis 16 in a direction extending towards end 40. Ramp 34 is adjacent ramp 30.

The second connector body comprises at least one connector. In the embodiment of FIG. 1, the second connector body 18 includes two connectors 48 although more of less connectors 48 may be provided. Each connector 48 includes a beam 50. In the embodiment of FIG. 1, beam 50 is in the form of a flexible segment which extends in the direction of axis 22 from a proximate end 52 to a distal end 54. A pin 56 protrudes from the distal end 54 towards axis 22. As described hereinafter, each pin 56 (a) engages a ramp 30 in a connecting mode, (b) compresses the elastic member 36 and engages a latch groove 26 in a connected mode, and (c) further compresses the elastic member and sequentially engages a ramp 32, a groove 28 and a ramp 34 in a disconnecting mode, as described herein.

As depicted in FIG. 1, the two connectors 24 form a pair of connectors which are spaced from each other about 180° in a circumferential direction 58, 58' relative to axis 16. Similarly, as depicted in FIG. 1, the two connectors 48 are spaced from each other about 180° in a circumferential direction 60, 60' relative to axis 22 so that they may be aligned with respective connectors 24, as described herein. One or more additional pair of identical connectors 24, and one or more additional pair of identical connectors 48, may be provided, if desired. Regardless of how many connectors 24 and 48 are provided, the spacing in the circumferential directions 58, 58' for the connectors 24, and in the circumferential direction 60, 60' for the connectors 48, will be such that respective connectors 24, will be in alignment with respective connectors 48, during use. As will be evident from FIG. 1, the two connectors 24 and the ramps and latch grooves of each, are spaced from each other about 180° in direction 58, 58'.

The present invention will now be described regarding the embodiment illustrated in FIGS. 1 to 4 and the diagrammatic plan view thereof illustrated in FIG. 5. In considering FIG. 5, it should be noted that although the elastic member 36 may be, for example, an elastomeric block which has been wedged as illustrated in FIG. 2 between the surface 70 of the latch groove 26 and the surface 70' of the latch groove 28, FIG. 5 merely illustrates a portion of that surface of the elastic member 36 which the end 54 of segment 50 engages to compress the elastic member as the first connector body 12 and second connector body 14 are connected together. In the embodiment of FIGS. 1 to 4, a positive latch connector is illustrated which comprises two connectors 24 and two corresponding connectors 48. It will be apparent to those skilled in the art that the following description is also applicable to embodiments having more or less than two such connectors.

In use, the connector body 18 is first oriented relative to the connector body 12 such that axes 16 and 22 are coincident and pins 56 are in axial alignment with respective ramps 30. Connectors 12 and 18 may then be moved relative to each other in directions 14', 20 causing pins 56 to engage respective ramps 30 in a connecting mode. By dimensioning the connectors such that the distance 62 between the tips of the pins 56 is about equal to or only slightly greater than the distance 64 between edges 66 of ramps 30, such movement will cause ramps 30 to serve as cam surfaces for pins 56 to urge flexible segments 50 away from each other until the pins reach edges 68 of ramps 30. Although not necessary, in the embodiment illustrated in the drawings edge 66 is a greater distance below outer peripheral surface 38 than is edge 68. As the pins move beyond edges 68, the distal ends 54 of segments 50 will continue to engage and compress an elastic member 36 overcoming the increasing resistance thereof until the resilience of the flexible segments 50 cause pins 56 to snap into latch grooves 26 (FIG. 2) to lock the connectors 12 and 18 in place relative to each other in a connected mode. Such snapping will provide tactile evidence of a completed connection. The connector 12 will not be inadvertently disconnected due to the fact that the pins 56 will be urged in direction 14' against the walls 70 at the end of the ramps 30 by an elastic member 36. If the pins 56 are not pushed over the edges 68 the resistance effected by compressed elastic member 36 will push the connector bodies apart indicating incomplete mating and thereby providing visual and tactile evidence of an incomplete connection.

Figure 5:
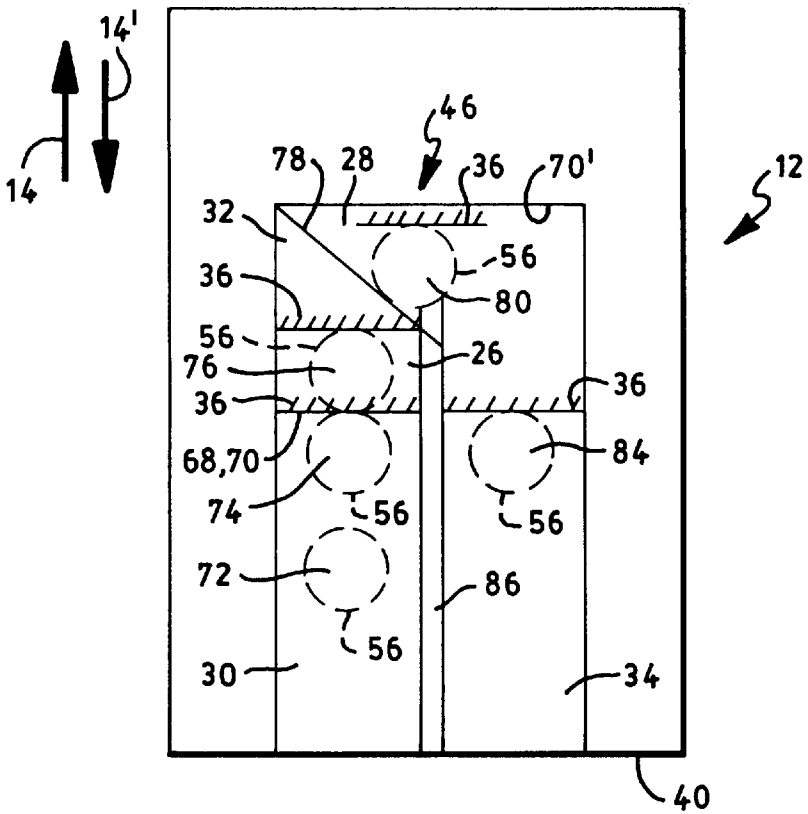
FIG. 5 is a diagrammatic representation of the embodiment of the present invention of FIGS. 1 to 4 sequentially illustrating the mode of operation thereof.

Such connecting movement is diagrammatically illustrated in FIG. 5. At 72 a pin 56 first engages and slides upon ramp 30 in direction 14. At 74 pin 56 engages the elastic member 36 and begins to compress it. At 76 pin 56 has sufficiently compressed the elastic member 36 so that the resiliency of the flexible segments 50 causes the pin to snap into latch groove 26 and the resilience of the elastic member 36 urges the pin in direction 14' against the wall 70.

When it is desired to disconnect the positive latch connector 10, the user exerts a force upon the first connector body 12 in direction 14. The user must apply sufficient force to overcome the increasing resistance presented in the direction 14' by the elastic members 36, to cause the elastic members to be further compressed and the pins 56 to slide up the ramps 32. In this manner, the elastic members prevent inadvertent disconnection of the device. As the pins 56 slide beyond the edge 78 of ramp 32, the resilience of the flexible segments 50 cause the pins 56 to snap into the latch grooves 28 and engage bases 46. Although not necessary, edge 78 is disposed below edge 68 as illustrated in FIG. 2. The user discontinues applying a force upon the first connector body 12 in direction 14, and the resultant forces of each elastic member 36 urge the first connector body 12 in direction 14' causing the pins 56 to slide from bases 46 to the ramps 34. The resiliency in the elastic member will continue to urge the first connector body 12 in direction 14' causing 56 to slide up ramps 34 until the elastic member is fully decompressed and assumes its original position adjacent edge 68. In this manner, the resiliency of each elastic member 36 facilitates disconnection. The user can then completely remove the first connector body 12 from the second connector body 18 by pulling the first connector body in direction 14'.

Such disconnecting movement is diagrammatically illustrated in FIG. 5. At 80 the force applied by the user in direction 14 has overcome the resistance of the elastic member 36 and allowed the pin 56 to slide up ramp 32 and sufficiently compress the elastic member 36 so that the resiliency of the flexible segments 50 causes the pin 56 to snap into latch groove 28. At 84 the resiliency of the elastic member urges the second connector body 18 in direction 14' as the pin slides from base 46 up ramp 34.

Figure 6:
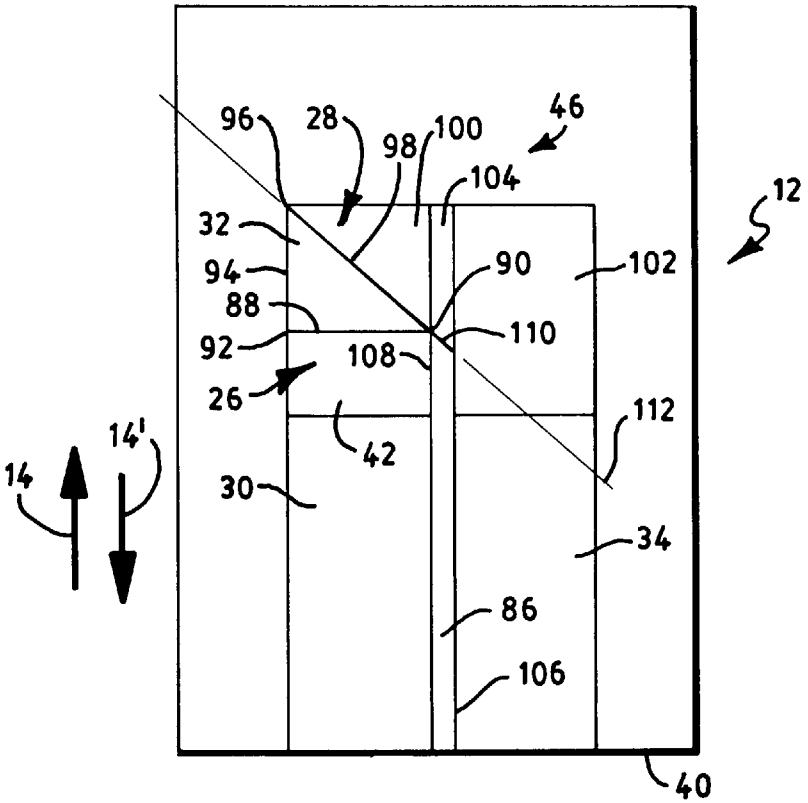
FIG. 6 is a plan view of the first connector body 12 of the embodiment of the present invention illustrated in FIG. 1.

With reference to FIG. 6, the base 42 of latch groove 26 is adjacent ramps 30 and 32, and the base 46 of latch groove 28 is adjacent ramp 32 and ramp 34. In order to facilitate directing the pins 56 along ramp 30 and to contain the pins within the latch groove 26, a wall 86 may be provided. Wall 86 extends in the direction of axis 16 between the ramp 30 and latch groove 26, on the one hand, and the ramp 34, on the other.

In order to facilitate movement of pin 56 from the ramp 32 to the latch groove 28, ramp 32 may comprise a triangularly configured ramp surface as illustrated in FIG. 6. In the embodiment illustrated in the drawings, such triangularly configured ramp surface includes a first edge 88 which is coextensive with an edge of base 42 and extends from a first point 90 at wall 86 to an opposite second point 92. A second edge 94 is substantially perpendicular to the first edge 88 and extends from point 92 to an opposite third point 96. The third edge 98 of the triangularly configured ramp surface extends from the first point 90 to the third point 96. It will be readily apparent from FIG. 6 that such triangularly configured ramp surface will not only facilitate movement of the pins 56 from the latch groove 28 but will facilitate movement of the pin 56 towards the ramp 34.

In order to further facilitate movement of the pin 56 from the base 46 to the ramp 34, each base 46 may include a first surface 100 adjacent the ramp 32, and a second surface 102 adjacent the ramp 34, the surface 100 being joined to the surface 102 by a third surface 104. The surface 104 extends at an angle from surface 100 to surface 102 to further facilitate movement of pin 56.

Movement of pin 56 from base 46 to the ramp 34 may be further facilitated by modifying one end of wall 86 to provide a beveled surface. For example, in the embodiment illustrated in the drawings, wall 86 extends from an end 106 adjacent the end 40 of the first connector body 12 to an end 108 adjacent the junction between the latch groove 26 and the ramp 32. End 108 of the wall 86 may include a beveled edge or surface 110 so that end 108 does not impede movement of the pin 56. In the embodiment illustrated in FIG. 6, the third edge 98 of the triangularly configured ramp surface 32 may extend along an axis 112, and beveled surface 110 may extend along axis 112.

In considering the use of the positive latch connector 10 in one practical application, the connector bodies 12 and 18 may be in the form of cylindrical sleeves as depicted in FIG. 1. Such sleeves include bores 114 and 116 which extend completely through connector bodies 12 and 18, respectively. An electrical male antenna connector 118 may be positioned in bore 116, and a mating electrical female antenna connector 120 may be positioned in bore 114, in a conventional manner. When the connector bodies 12 and 18 are connected as described above, male connector 118 will extend into the female connector 120 in the usual manner to provide the desired electrical connection between the two. When in the connected mode, the connector bodies 12 and 18 will be mechanically locked to each other as a result of the abutment of each pin 56 with a respective wall 70 as described herein. In this manner, the electrical connection between electrical connectors 118 and 120 will not be unintentionally disconnected; that is, electrical connection will be assured until the connector bodies 12 and 18 are disconnected.

The embodiments which have been described herein are but some of several which utilize this invention and are set forth here by way of illustration but not of limitation. It is apparent that many other embodiments which will be readily apparent to those skilled in the art may be made without departing materially from the spirit and scope of this invention.

I claim:

1. A positive latch electrical connector, comprising:

a first connector body extending in the direction of a first axis and comprising at least one first connector which comprises and outer surface and:

a first latch groove extending into said outer surface of said first connector body to a first base of said first latch groove, said first latch groove being positioned between a first end of said first connector body and a second end of said first connector body;

a second latch groove extending into said outer surface to a second base of said second latch groove, said second latch groove being positioned between said first latch groove and said second end;

a first ramp inclined upward from said first axis in a direction extending from said first end towards said first latch groove;

a second ramp inclined away from said first axis in a direction extending from said first latch groove towards said second latch groove;

an elastic member extending between said first latch groove and said second latch groove; and a third ramp adjacent to at least said first ramp and inclined away from said first axis in a direction extending towards said first end; and a second connector body extending in the direction of a second axis and comprising at least one second connector which comprises a beam which comprises a pin which (a) engages said first ramp in a connecting mode, (b) compresses said elastic member and engages said first latch groove in a connected mode, and (c) further compresses said elastic member and sequentially engages said second ramp, said second latch groove and said third ramp in a disconnecting mode.

2. The connector of claim 1 wherein said at least one first connector includes one first connector and another first connector spaced from said one first connector about 180° in a circumferential direction relative to said first axis, and further wherein said at least one second connector includes one second connector and another second connector spaced from said one second connector about 180° in a circumferential direction relative to said second axis.

3. The connector of claim 2 wherein said beam comprises a flexible segment which extends in the direction of said second axis from a proximate end to a distal end, said pin protruding from said distal end towards said second axis.

4. The connector of claim 2 wherein said first ramp, said second ramp and said third ramp of said one first connector are spaced from said first ramp, said second ramp and said third ramp of said another first connector about 180° in a circumferential direction relative to said first axis.

5. The connector of claim 1 wherein said first base is adjacent said first ramp and said second ramp, and said second base is adjacent said second ramp and said third ramp.

6. The connector of claim 1 further including a wall which extends in the direction of said first axis between (a) said first ramp and said first latch groove, and (b) said third ramp.

7. The connector of claim 4 wherein said wall includes one wall end which extends towards said first end and an opposite wall end which extends towards said second end, said opposite wall end comprising a beveled surface.

8. The connector of claim 1 wherein said second ramp comprises a triangularly configured ramp surface.

9. The connector of claim 6 wherein said second ramp comprises a triangularly configured ramp surface having a first edge which is coextensive with said first base and extends from a first point at said wall to an opposite second point, a second edge which is substantially perpendicular to said first edge and extends away from said first base from said second point to an opposite third point, and a third edge which extends from said first point to said third point.

10. The connector of claim 1 wherein said second base includes a first surface adjacent said second ramp and a second surface adjacent said third ramp, said first surface being joined to said second surface by a third surface, said third surface extending at an angle from said first surface to said second surface.

11. The connector of claim 1 wherein said beam comprises a flexible segment which extends in the direction of said second axis from a proximate end to a distal end, said pin protruding from said distal end towards said second axis.

12. The connector of claim 1 wherein said elastic member comprises an elastomer.

13. A positive latch electrical connector, comprising:

a first connector body extending in the direction of a longitudinal first axis and comprising at least one first connector which comprises an outer surface and:

a first latch groove extending into said outer surface of said first connector body, said first latch groove being spaced from a first end of said first connector body in the direction of said first axis, said first latch groove comprising a first base segment which is disposed below an outer peripheral surface of said first connector body;

a second latch groove extending into said outer surface, said second latch groove being spaced from said first end in the direction of said first axis and being positioned between said first latch groove and a second end of said first connector body, said second latch groove comprising a second base segment which is disposed below said outer peripheral surface;

a first ramp which extends, and is inclined away from said first axis from said first end to said first latch groove, said first ramp having a first edge adjacent said first end, said first edge being disposed below said outer peripheral surface a first distance, said first ramp having an opposite second edge adjacent said latch groove, said second edge being disposed below said outer peripheral surface a second distance which is less than said first distance;

a second ramp which extends, and is inclined away from, said first axis from said first base segment to said second latch groove, said second ramp having a third edge adjacent said first base segment and an opposite fourth edge, said opposite fourth edge being disposed below said second edge;

a third ramp which extends, and is inclined away from, said first axis from said second latch groove to said first end, said third ramp having one segment adjacent said first end and another opposite segment adjacent said second latch groove; and an elastic member extending between said first latch groove and said second latch groove; and a second connector body extending in the direction of a longitudinal second axis and comprising at least one second connector which comprises a beam which comprises a pin which (a) engages said first ramp in a connecting mode, (b) compresses said elastic member and engages said first latch groove in a connected mode, and (c) further compresses said elastic member and sequentially engages said second ramp, said second latch groove and said third ramp in a disconnecting mode.

14. The connector of claim 13 wherein said at least one first connector includes one first connector and another first connector spaced from said one first connector about 180° in a circumferential direction relative to said first axis, and further wherein said at least one second connector includes one second connector and another second connector spaced from said one second connector about 180° in a circumferential direction relative to said second axis.

15. The connector of claim 13 further including a wall which extends in the direction of said first axis between (a) said first ramp and said first latch groove, and (b) said third ramp.

16. The connector of claim 15 wherein said second ramp comprises a triangularly configured ramp surface having a first edge which is coextensive with said first base and extends from a first point at said wall to an opposite second point, a second edge which is substantially perpendicular to said first edge and extends away from said first base from said second point to an opposite third point, and a third edge which extends from said first point to said third point.

17. The connector of claim 16 wherein said wall extends from one wall end adjacent said first end to another wall end adjacent said first point, said another wall end comprising a beveled surface.

18. The connector of claim 17 wherein said third edge extends along a third axis from said first point to said third point, and said beveled surface extends along said third axis.

19. The connector of claim 13 wherein said second base includes a first surface adjacent said second ramp and a second surface adjacent said third ramp, said first surface being joined to said second surface by a third surface, said third surface extending at an angle from said first surface to said second surface.

20. The connector of claim 13 wherein said elastic member comprises an elastomer.

* * * * *